US010889110B2

(12) United States Patent
Jackson et al.

(10) Patent No.: US 10,889,110 B2
(45) Date of Patent: Jan. 12, 2021

(54) METHOD AND APPARATUS FOR DROPLET DEPOSITION

(71) Applicant: XAAR TECHNOLOGY LIMITED, Cambridge (GB)

(72) Inventors: Nicholas Marc Jackson, Cambridge (GB); Angus Condie, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/619,605

(22) PCT Filed: Jun. 6, 2018

(86) PCT No.: PCT/GB2018/051537
§ 371 (c)(1),
(2) Date: Dec. 5, 2019

(87) PCT Pub. No.: WO2018/224821
PCT Pub. Date: Dec. 13, 2018

(65) Prior Publication Data

US 2020/0130352 A1 Apr. 30, 2020

(30) Foreign Application Priority Data

Jun. 6, 2017 (GB) ..... 1709027.5

(51) Int. Cl.
*B41J 2/045* (2006.01)
*B41J 2/14* (2006.01)

(52) U.S. Cl.
CPC ..... *B41J 2/04581* (2013.01); *B41J 2/04588* (2013.01); *B41J 2/04541* (2013.01);
(Continued)

(58) Field of Classification Search
CPC ..... B41J 2/04525; B41J 2/04541; B41J 2/04581; B41J 2/04588; B41J 2/04595;
(Continued)

(56) References Cited

U.S. PATENT DOCUMENTS 5,512,922 A 4/1996 Paton
8,567,889 B2 10/2013 Drury et al.
(Continued)

FOREIGN PATENT DOCUMENTS

CN 1159785 A 9/1997
CN 1280917 A 1/2001
(Continued)

OTHER PUBLICATIONS

Combined Search and Examination from the UK Intellectual Property Office for GB Application No. GB1709027.5, dated Nov. 28, 2017 (6 pages).
(Continued)

*Primary Examiner* — Anh T Vo
(74) *Attorney, Agent, or Firm* — Finnegan, Henderson, Farabow, Garrett & Dunner LLP

(57) ABSTRACT

A method for depositing droplets onto a medium, utilising a droplet deposition head is provided. The head used in the method includes: an array of fluid chambers separated by interspersed walls, each fluid chamber communicating with an aperture for the release of fluid droplets and each wall separating two neighbouring chambers. Each wall is actuable such that, in response to a first voltage, it will deform so as to decrease the volume of one chamber and increase the volume of the other chamber, and, in response to a second voltage, it will deform so as to cause the opposite effect on the volumes of its neighbouring chambers. The method includes the steps of: receiving input data; assigning, based on such input data, all the chambers within the
(Continued)

array as either firing chambers or non-firing chambers, so as to produce bands of one or more contiguous firing chambers separated by bands of one or more contiguous non-firing chambers; actuating the walls of certain of the chambers such that: for each non-firing chamber, either one wall is stationary while the other is moved, or the walls move with the same sense, or they remain stationary; and, for each firing chamber the walls move with opposing senses; such actuations result in each firing chamber releasing at least one droplet, the resulting droplets forming bodies of fluid disposed on a line on the medium, such bodies of fluid being separated on the line by respective gaps for each of the bands of non-firing chambers, the size of each such gap generally corresponding in size to the respective band of non-firing chambers. The actuations of the walls of said firing chambers in the actuating step are such that, if only one of the two walls of each firing chamber were actuated in such manner, no droplets would be ejected from that firing chamber. A droplet deposition apparatus, a droplet deposition head and a computer program product are also provided.

20 Claims, 6 Drawing Sheets

(52) U.S. Cl.
CPC ..... *B41J 2/04596* (2013.01); *B41J 2/14209* (2013.01); *B41J 2002/14491* (2013.01); *B41J 2202/11* (2013.01)

(58) Field of Classification Search
CPC ..... B41J 2/04596; B41J 2/14209; B41J 2202/10; B41J 2202/14491; B41J 2202/06
See application file for complete search history.

(56) References Cited

U.S. PATENT DOCUMENTS

| | | | | |
|---|---|---|---|---|
| 9,079,393 | B2 | 7/2015 | Hiyoshi et al. | |
| 9,199,453 | B2 | 12/2015 | Ono et al. | |
| 10,500,854 | B2 * | 12/2019 | Condie | B41J 2/04525 |
| 2009/0141058 | A1 * | 6/2009 | Uraki | B41J 2/04596 347/11 |
| 2011/0261101 | A1 | 10/2011 | Drury et al. | |
| 2011/0261119 | A1 | 10/2011 | Drury et al. | |
| 2014/0160194 | A1 | 6/2014 | Ono et al. | |
| 2014/0176627 | A1 | 6/2014 | Ono et al. | |

FOREIGN PATENT DOCUMENTS

| | | | |
|---|---|---|---|
| CN | 102209636 | A | 10/2011 |
| CN | 103862868 | A | 6/2014 |
| CN | 104589795 | A | 5/2015 |
| EP | 0422870 | A2 | 4/1991 |
| EP | 0783410 | A1 | 7/1997 |
| EP | 1070589 | A2 | 1/2001 |
| EP | 2352646 | A1 | 8/2011 |
| WO | WO96/10488 | A1 | 4/1996 |
| WO | WO2007/007074 | A1 | 1/2007 |
| WO | WO2007/113554 | A2 | 10/2007 |
| WO | WO2010/055345 | A1 | 5/2010 |

OTHER PUBLICATIONS

International Search Report and Written Opinion for International Application No. PCT/GB2018/051537, dated Aug. 10, 2018 (13 pages).
First Office Action dated Oct. 10, 2020 in corresponding Chinese Application No. 201880031871.6 (8 pgs.) and machine translation (10 pgs.).
Examination Report dated Sep. 17, 2020 in corresponding United Kingdom application GB1709027.5 (4 pgs.).

* cited by examiner

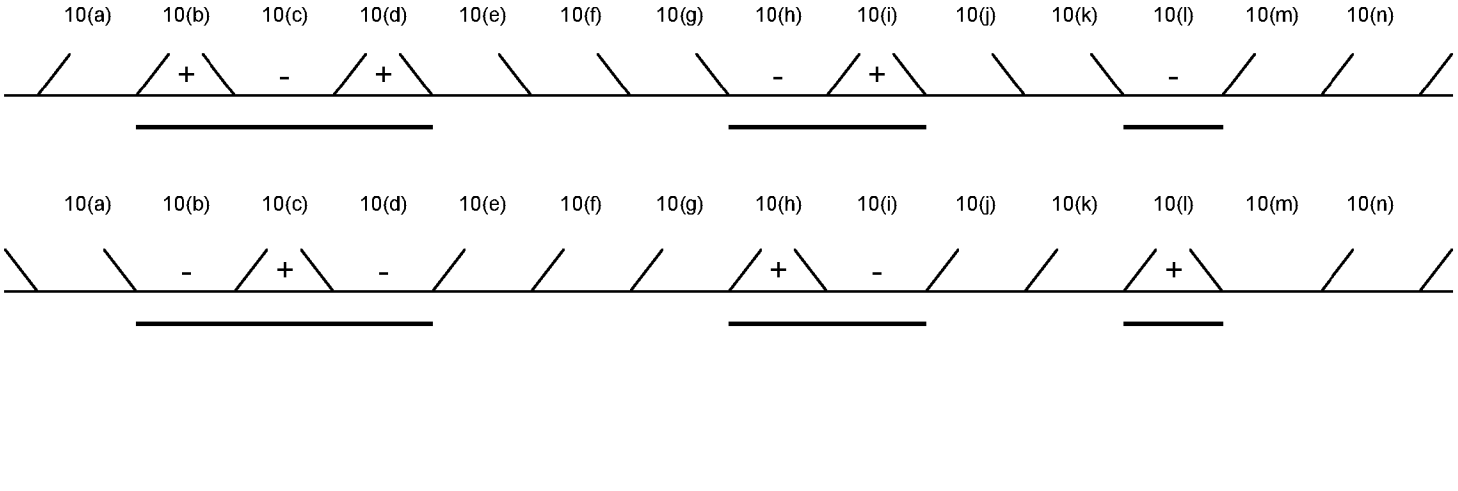
Figure 9(a)
Figure 9(b)
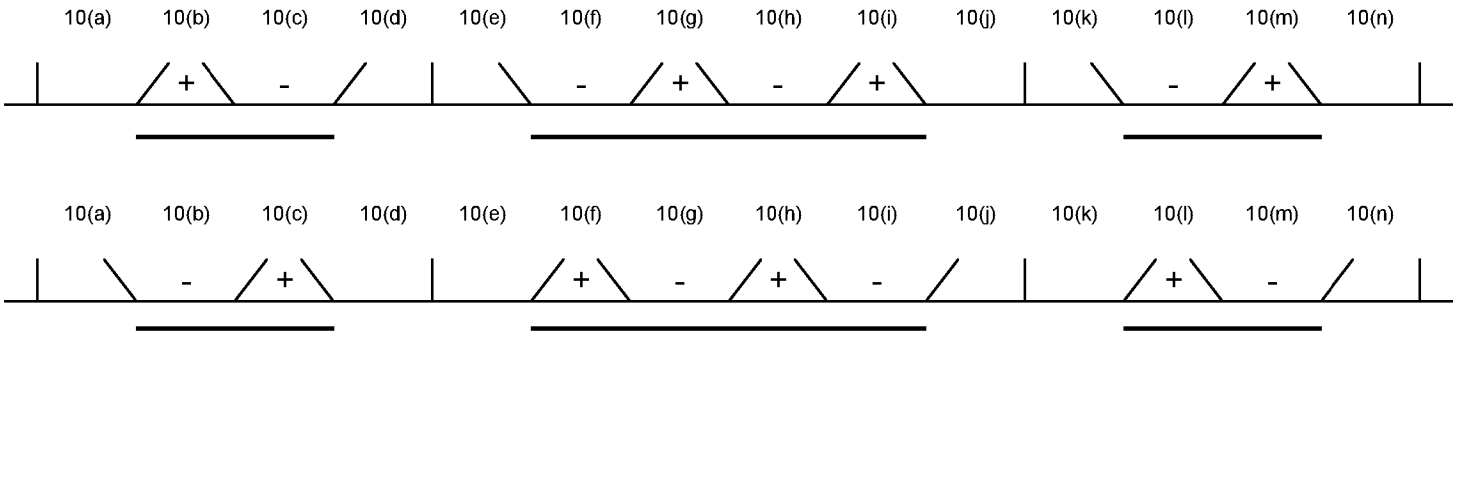
Figure 10(a)
Figure 10(b)

METHOD AND APPARATUS FOR DROPLET DEPOSITION

This application is a National Stage Entry of International Application No. PCT/GB2018/051537, filed Jun. 6, 2018, which is based on and claims the benefit of foreign priority under 35 U.S.C. § 119 to GB Application No. 1709027.5, filed Jun. 6, 2017. The entire contents of the above-referenced applications are expressly incorporated herein by reference.

The present invention relates to a method for depositing droplets onto a medium utilising a droplet deposition head, such as a printhead, and to droplet deposition heads and droplet deposition apparatus comprising such droplet deposition heads, which are configured to carry out such methods.

Droplet deposition heads are now in widespread usage, whether in more traditional applications, such as inkjet printing, or in materials deposition applications, such as 3D printing and other rapid prototyping techniques, and the printing of raised patterns on surfaces, e.g. braille or decorative raised patterns. In such materials deposition applications, it may be desired to deposit a relatively large amount of fluid on a medium using droplet deposition heads. In some cases, the fluids may have novel chemical properties to adhere to new mediums and increase the functionality of the deposited material.

Recently, inkjet printheads have been developed that are capable of depositing inks and varnishes directly onto ceramic tiles, with high reliability and throughput. This allows the patterns on the tiles to be customized to a customer's exact specifications, as well as reducing the need for a full range of tiles to be kept in stock.

In still other applications, droplet deposition heads may be used to form elements such as colour filters in LCD or OLED displays used in flat-screen television manufacturing.

It will therefore be appreciated that droplet deposition heads continue to evolve and specialise so as to be suitable for new and/or increasingly challenging deposition applications. Nonetheless, while a great many developments have been made in the field of droplet deposition heads, there remains room for improvements in the field of droplet deposition heads.

SUMMARY

Aspects of the invention are set out in the appended claims.

The present disclosure provides, in one aspect, a method for depositing droplets onto a medium utilising a droplet deposition head comprising: an array of fluid chambers separated by interspersed walls, each fluid chamber communicating with an aperture for the release of droplets of fluid and each of said walls separating two neighbouring chambers; wherein each of said walls is actuable such that, in response to a first voltage, it will deform so as to decrease the volume of one chamber and increase the volume of the other chamber, and, in response to a second voltage, it will deform so as to cause the opposite effect on the volumes of said neighbouring chambers; the method comprising the steps of: (a) receiving input data; (b) assigning, based on said input data, all the chambers within said array as either firing chambers or non-firing chambers so as to produce bands of one or more contiguous firing chambers separated by bands of one or more contiguous non-firing chambers; (c) actuating the walls of certain of said chambers such that: for each non-firing chamber, either one wall is stationary while the other is moved, or the walls move with the same sense, or they remain stationary; and for each firing chamber the walls move with opposing senses; said actuations resulting in each said firing chamber releasing at least one droplet, the resulting droplets forming bodies of fluid disposed on a line on said medium, said bodies of fluid being separated on said line by respective gaps for each of said bands of non-firing chambers, the size of each such gap generally corresponding in size to the respective band of non-firing chambers; wherein the actuations of the walls of said firing chambers in said actuating step, (c), are such that, if only one of the two walls of each firing chamber were actuated in such manner, no droplets would be ejected from that firing chamber.

In a further aspect, the present disclosure provides a droplet deposition apparatus, which comprises one or more droplet deposition heads, each head comprising: an array of fluid chambers separated by interspersed walls, each fluid chamber being provided with an aperture and each of said walls separating two neighbouring chambers; each of said walls being actuable such that, in response to a first voltage, it will deform so as to decrease the volume of that chamber and increase the volume of the other chamber, in response to a second voltage, it will deform so as to cause the opposite effect on the volumes of said neighbouring chambers. Such a droplet deposition apparatus is configured to carry out a method as described herein.

In a still further aspect, the present disclosure provides a droplet deposition head comprising: an array of fluid chambers separated by interspersed walls, each fluid chamber being provided with an aperture and each of said walls separating two neighbouring chambers; each of said walls being actuable such that, in response to a first voltage, it will deform so as to decrease the volume of that chamber and increase the volume of the other chamber, in response to a second voltage, it will deform so as to cause the opposite effect on the volumes of said neighbouring chambers. Such a droplet deposition head is configured to carry out a method as described herein.

BRIEF DESCRIPTION OF THE DRAWINGS

The invention will now be described with reference to the drawings, in which:

FIG. 9 is a representation of a method of operating a droplet deposition apparatus according to a contrasting example, with the same input data being used as in FIG. 8;

FIG. 10 is a representation of a method of operating a droplet deposition apparatus according to a further example embodiment of the present invention that utilises the same input data as in FIG. 8;

DETAILED DESCRIPTION OF THE DRAWINGS

Described further below with reference to FIGS. 7, 8, and 10 to 14 are various example embodiments of methods for depositing droplets onto a medium utilising a droplet deposition head, such as a printhead. However, before discussing in detail such example embodiments, there will be described with reference to FIGS. 1 to 6 various illustrative constructions of droplet deposition heads that are suitable to be configured for use with such methods.

Figure 1:
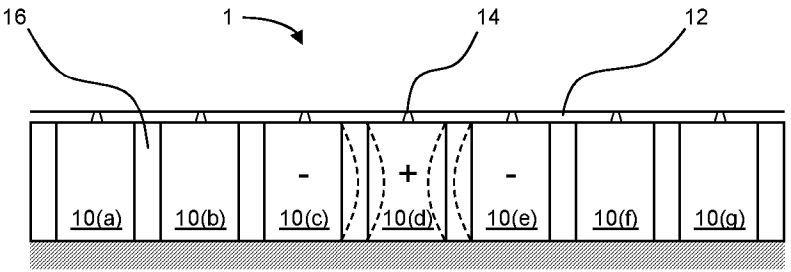
Figure 1 (PRIOR ART)
FIG. 1 shows a known construction of a droplet deposition apparatus.

Attention is therefore firstly directed to FIG. 1, which shows a cross-section taken through an array of fluid chambers in a known droplet deposition head.

It is known within the art to construct droplet deposition head comprising an array of fluid chambers separated by a plurality of walls that are actuable in response to electrical signals. Such walls may, for example, comprise piezoelectric material (though in other constructions they might, for instance, be electrostatically actuable). In many such constructions, the walls are actuable in response to electrical signals to move towards one of the two chambers that each wall bounds; such movement affects the fluid pressure in both of the chambers bounded by that wall, causing a pressure increase in one and a pressure decrease in the other.

Nozzles or apertures are provided in fluid communication with the chamber in order that a volume of fluid may be ejected therefrom. The fluid at the aperture will tend to form a meniscus owing to surface tension effects, but with a sufficient perturbation of the fluid this surface tension is overcome allowing a droplet or volume of fluid to be released from the chamber through the aperture; the application of excess positive pressure in the vicinity of the aperture thus causes the release of a body of fluid.

FIG. 1 illustrates s specific exemplary construction of a droplet deposition head 1 having an array of fluid chambers 10(*a*)-(*g*) that are separated by actuable walls 16. In the particular example shown, the chambers 10(*a*)-(*g*) are conveniently formed as channels enclosed on one side by a cover member 12 that contacts the actuable walls 16, with respective nozzles 14 for fluid ejection are provided in this cover member 12; however, it will be understood that a wide variety of suitable constructions may provide similar functionality.

The cover member 12 may, for example, comprise a metal or ceramic cover plate, which provides structural support, and a thinner overlying nozzle plate, in which the nozzles 14 are formed, or a relatively thin nozzle plate might be used on its own as a cover member 12, as taught in WO2007/113554A, for example.

As shown in FIG. 1, the actuation of the walls 16 of a chamber 10 may cause the release of fluid from that chamber through its nozzle 14. In the case shown in FIG. 1, both the walls of 16 a particular chamber 10(*d*) are deformed inwards, this movement causing an increase in the fluid pressure within the chamber 10(*d*) in question and a decrease in pressure of the two neighbouring chambers 10(*c*), 10(*e*). The increase in pressure within the chamber 10(*d*) in question contributes to the release of a droplet of fluid through the nozzle 14 of that chamber 10(*d*).

In constructions such as FIG. 1 where all chambers 10(*a*)-(*g*) are provided with a nozzle 14, every chamber 10(*a*)-(*g*) may be capable of fluid release. It will be apparent however, that since the actuation of a particular wall 16 has a different effect on the pressure in its two adjacent channels, simultaneous release of fluid from both of the chambers 10 separated by a particular wall 16 is difficult to achieve.

To actuate the walls, the head will typically include a plurality of electrodes that are connected (or connectable) to drive circuitry, for example in the form of a driver IC on-board, or off-board the head.

In some cases, the two walls of each chamber may share a corresponding electrode, so that there is one electrode for each pair of neighbouring walls. In a particular example, each chamber may be coated internally with a metal layer that acts as an electrode, which may be used to apply a voltage across the walls of that chamber and thus cause the walls to deflect or move by virtue of the piezoelectric effect. The voltage applied across each wall 16 will thus be the difference between the signals applied to the adjacent chambers. Where a wall 16 is to remain undeformed, there must be no difference in potential across the wall 16; this may of course be accomplished by applying no signal to either of the adjacent channel electrodes, but may also be achieved by applying the same signal to both channels.

The piezoelectric walls may, for instance, comprise an upper and a lower half, divided in a plane defined by the array direction and the channel extension direction. These upper and lower halves of the piezoelectric walls may be poled in opposite directions perpendicular to the channel extension and array directions so that when a voltage is applied across the wall 16 perpendicular to the array direction the two halves deflect in 'shear-mode' so as to bend towards one of the fluid chambers; the shape adopted by the deflected walls 16 resembles a chevron.

Nonetheless, it should be understood that other methods of providing electrodes and poling walls have been proposed, which afford the ability to deflect the walls in a similar bending motion.

Apparatus such as that depicted in FIG. 1 is commonly referred to as a 'side-shooter' owing to the placement of the nozzle 14 generally in the longitudinal side of the fluid chambers. As the drawing shows, the nozzle 14 may for example be provided equidistant of each longitudinal end. In such constructions, the ends of the channels will often be left open to allow all channels to communicate with one or more common fluid manifolds. This further allows a flow to be set up along the length of the chamber during use of the apparatus so as prevent stagnation of the fluid and to sweep detritus within the fluid away from the nozzle 14. It is often found to be advantageous to make this flow along the length of the chamber greater than the maximum flow through the nozzle 14 due to fluid release. Put differently, when the apparatus is operated at maximum ejection frequency the average flow of fluid through each nozzle 14 is less than the flow along each channel. In some cases this flow can be at least five or even ten times greater than the maximum flow through the nozzle 14 due to fluid release.

Figure 4B:
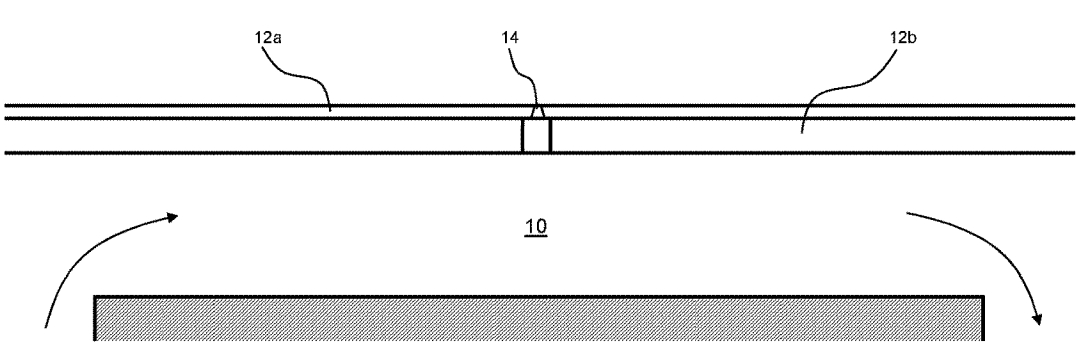
FIG. 4(*a*) shows an end-view and FIG. 4(*b*) a side-view of a still further exemplary construction of a droplet deposition apparatus where each chamber opens onto a manifold at opposing ends.
Figure 4A:
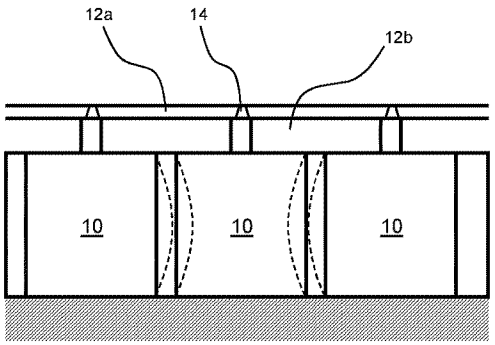

FIGS. 4(*a*) and 4(*b*) show a further example of a 'side shooter' construction, in which a cover plate 12*b* encloses the array of chambers 10 and a nozzle plate 12*a* overlies this cover plate; for each chamber, a corresponding ejection port is formed in the cover plate 12*b*, which communicates with the chamber 10 and a nozzle 14 to enable ejection of fluid from that chamber 10 through the nozzle 14. The chambers 10 open at either end of their lengths onto a common fluid supply manifold; separate common manifolds may be provided for each end or a single manifold for both ends may be provided. Movements of the piezoelectric walls separating the array of chambers generate acoustic waves within the chambers 10, which are reflected at the boundary between the chamber 10 and the common manifold due to the difference in cross-section area. In the head shown in FIGS. 4(*a*) and 4(*b*), these reflected waves will be of opposite sense to the waves incident on the channel ends, owing to the 'open' nature of the boundary. Further, a flow of fluid along each chamber 10 may be set up as described with reference to FIG. 1, as is shown in the view parallel to the array of channels in FIG. 4(*b*).

Figure 5B:
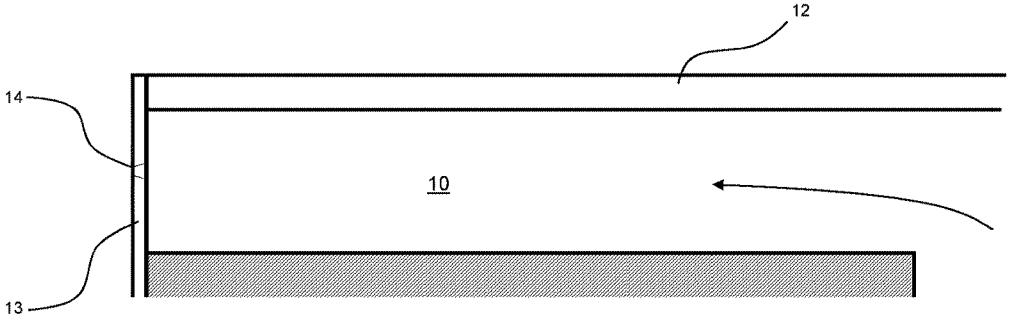
FIGS. 5(*a*) shows an end-view and 5(*b*) a side-view of yet a further exemplary construction of a droplet deposition apparatus where each chamber opens onto a manifold at only one end.
Figure 5A:
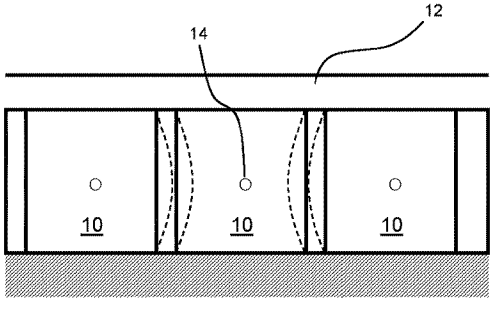

FIGS. 5(*a*) and 5(*b*) show an example of an 'end-shooter' construction, where nozzles 14 are formed in a nozzle plate 13 closing one end of each chamber 10, the other end of each chamber 10 opening on to a fluid supply manifold common to all chambers. In certain 'end-shooter' constructions, such as that proposed in WO2007/007074, a small channel 20 may be formed in the base in proximity to the nozzle 14 for egress of fluid from the chamber. The channel is of much smaller cross-section than the chamber 10 so as to effectively form a barrier to acoustic waves within the chamber. A flow of fluid may be set up along the length of each chamber 10, with fluid entering from the common manifold and leaving via the small channel provided adjacent each nozzle.

Figure 6B:
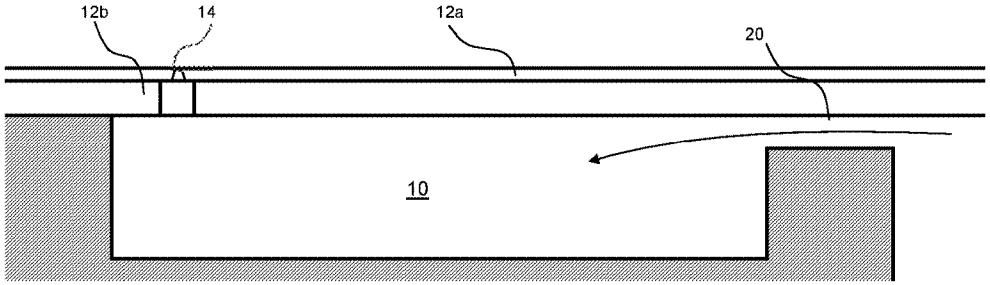
FIGS. 6(*a*) shows an end-view and 6(*b*) a side-view of a still further exemplary construction of a droplet deposition apparatus where a small passage connects each chamber to a manifold.
Figure 6A:
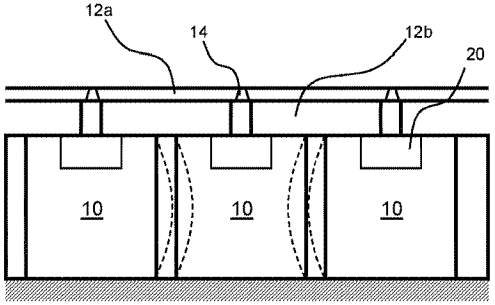

FIGS. 6(*a*) and 6(*b*) show a still further example of a droplet deposition head that may be configured to carry out methods of depositing droplets described below. This construction provides a nozzle plate 12*a* and cover plate 12*b* similar to that described with reference to FIGS. 4(*a*) and 4(*b*), but with each nozzle 14 provided towards one end in the side of the corresponding chamber 10. A support member defines each channel base and substantially closes each chamber at both ends of its length, with the exception of a small channel 20 provided at the opposite end of the chamber to the nozzle 14. This small channel 20 allows the ingress of fluid for ejection from the chamber 10 through the nozzle 14, but has a very much smaller cross-section than the chamber 10 itself so as to act as a barrier to acoustic waves within the chamber from reaching the supply manifold. Any acoustic waves generated by movements of the piezoelectric walls will thus be reflected by both ends of the chamber 10 as waves of the same sense.

In droplet deposition heads, such as those illustrated in FIGS. 1 to 6, where a wall 16 shared by two chambers 10 may be actuated, residual pressure disturbances will typically remain in the chambers after the actuation has occurred.

Figure 2:
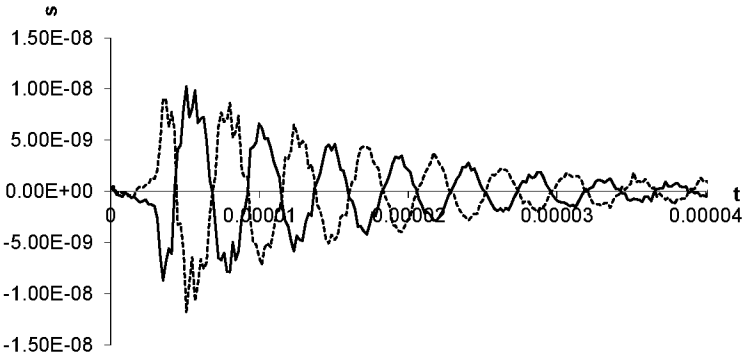
FIG. 2 shows the pressure response in two neighbouring chambers of a droplet deposition head generally as shown in FIG. 1, following the deformation of the wall separating the chambers.
Figure 3B:
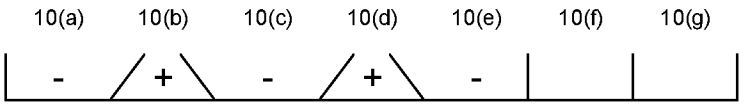
FIG. 3(*a*) shows the droplet deposition apparatus of FIG. 1 undergoing a different series of actuations, while FIG. 3(*b*) is a simplified representation of the same series of actuations.
Figure 3A:
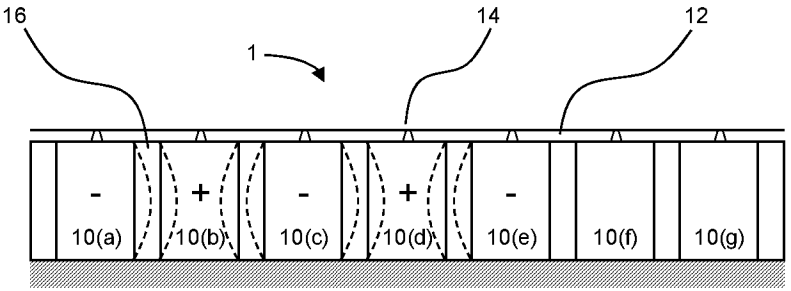

Experiments carried out by the Applicant using a head 1 generally as shown in FIG. 1 have provided the data shown in FIG. 2 for the displacement within a fluid (acting as a proxy for the pressure within the fluid) in two neighbouring chambers 10 following a single movement of the dividing wall 14. It is apparent from these data that the pressure in each chamber 10 oscillates about the equilibrium pressure (the pressure present in a chamber where no deformation of the walls takes place), with the amplitude of oscillation decaying to zero over time. The time taken for the amplitude to decay to zero is referred to hereinafter as the relaxation time ($t_R$) for the system.

Without wishing to be bound by the theory the Applicant believes that the oscillation of pressure is caused, at least in part, by acoustic pressure waves reflected at the ends of the fluid chambers 10. The period ($T_A$) of these standing waves may be derived from a graph such as FIG. 2 and is known as the acoustic period for the chamber 10. In the case of a long, thin chamber this period is approximately equal to L/c where L is the length of the chamber and c is the speed of sound propagation along the chamber 10 within the fluid.

As mentioned above, residual pressure waves are present in both chambers 10 either side of a wall 16 following the movement of that wall. The presence of such residual waves is apparent from the second and subsequent maxima in displacement shown in FIG. 2. Therefore, when fluid is released from a particular chamber, pressure disturbances may be present in one or both of the neighbouring chambers. For example, in some actuation schemes fluid is released from a particular chamber by the inward movement of both walls bounding that chamber, which will affect the pressure in both the neighbouring chambers. These pressure disturbances may interfere with fluid release from the neighbouring chambers in a phenomenon known as 'cross-talk'.

Droplet deposition head constructions have been proposed to ameliorate the problem of 'cross-talk'; for example, alternate chambers may be formed without nozzles, or may be otherwise permanently deactivated, so that these 'non-firing' chambers act to shield the chambers with apertures—the 'firing' chambers—from pressure disturbances. It will of course be apparent that, for a given chamber size, this has the undesirable consequence of halving the resolution available.

An earlier European patent application in the name of the Applicant, EP 0 422 870, proposes to retain a nozzle in each chamber and to instead ameliorate cross-talk with actuation schemes that pre-assign each chamber to one of three or more groups or 'cycles'. The chambers in turn are cyclically assigned to one of these groups so that each group is a regularly spaced sub-array of chambers. During operation, only one group is active at any time so that chambers depositing fluid are always spaced by at least two chambers, with the spacing dependent on the number of groups. User input data determines which specific chambers within each group are actuated. In more detail, the chambers within a cycle chamber may each receive a different number of pulses corresponding to the number of droplets that are to be released by that chamber, the droplets from each chamber merging to form a single mark or print pixel on the medium.

It will be apparent that at any one time only one third of the total number of chambers (or 1/n, where n is the number of cycles) may be actuated in this scheme and that therefore the rate of throughput is substantially decreased.

Additionally, the time delay between the firing of different groups can lead to the corresponding dots on the medium being spaced apart in the direction of relative movement of the medium and the apparatus. As noted briefly above, some head constructions address this problem by offsetting the nozzles for each cycle, so that the nozzles for each cycle lie on a respective line, the lines being spaced in the direction of movement of the medium, while this often successfully counteracts this particular problem, such head constructions are generally restricted to a particular firing scheme following nozzle formation.

EP 0 422 870 proposes a further actuator design where again a nozzle is provided in each chamber, but where the chambers are divided into two groups: odd-numbered and even-numbered chambers. Each group of chambers is synchronised to fire at the same time, with the specific input data determining which chambers within that group should be fired. The disclosure also discusses switching between the two groups at the resonant frequency of the chambers so that neighbouring chambers are fired in anti-phase.

It is noted in the document that this scheme grants a high throughput rate, but results in restrictions to the patterns that may be produced.

Still other examples exist of head designs and actuation schemes to address issues inherent in droplet deposition heads where each chamber is provided with a nozzle and where neighbouring chambers share actuable walls.

Figure 7A:
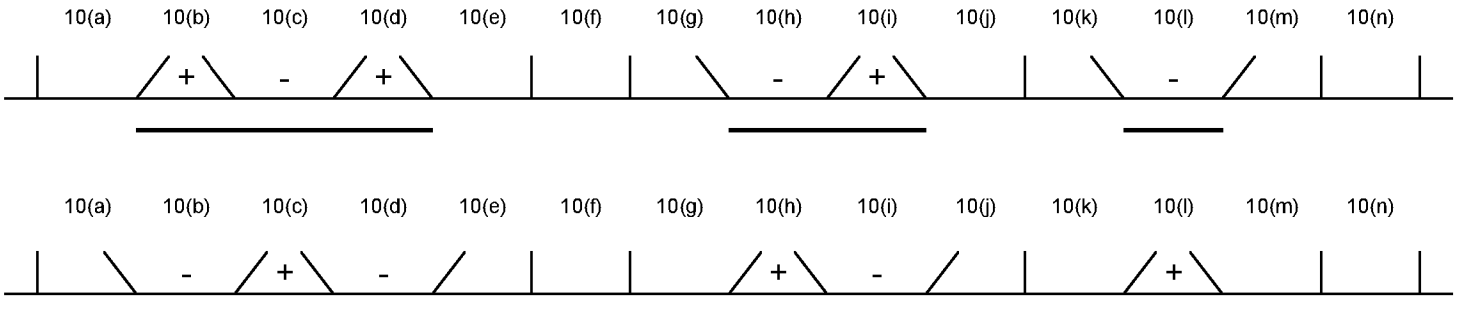
FIG. 7 is a representation of a method of operating a droplet deposition apparatus to produce a first pattern according to a first example embodiment.
Figure 7B:
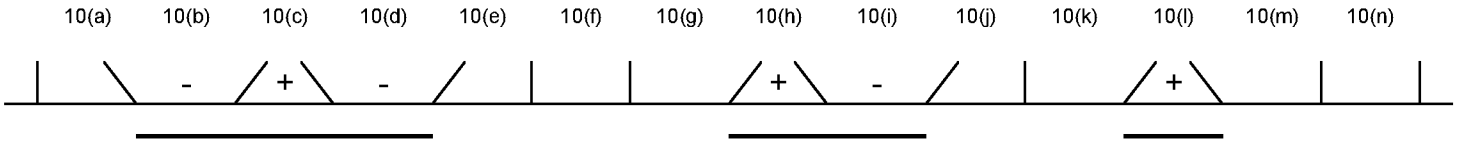
Figure 8A:
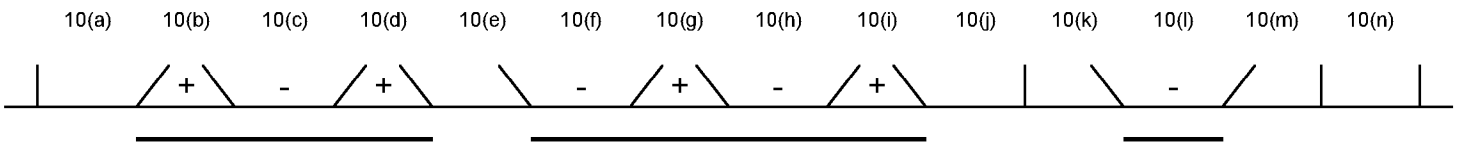
FIG. 8 is a representation of a method of operating a droplet deposition apparatus according to the same example embodiment as illustrated in FIG. 7, but with different input data being used.
Figure 8B:
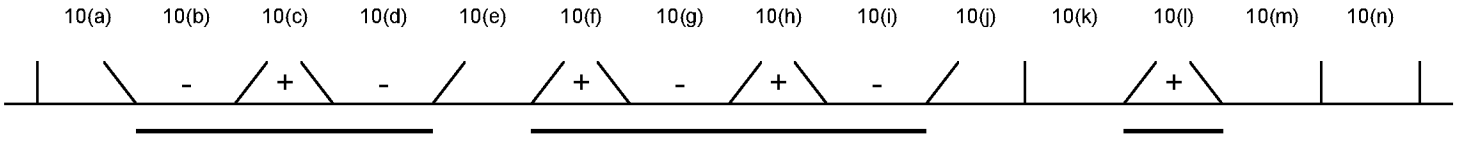

Attention is now directed to FIGS. 7, 8 and 10, which illustrate various example embodiments of a method for depositing droplets onto a medium utilising a droplet deposition head that: comprises an array of fluid chambers separated by interspersed walls, with each fluid chamber communicating with an aperture for the release of droplets of fluid and each of the walls separating two neighbouring chambers; and in which each of the walls is actuable such that, in response to a first voltage (e.g. a voltage of one polarity), it will deform so as to decrease the volume of one chamber and increase the volume of the other chamber, and, in response to a second voltage (e.g., a voltage of the opposite polarity) it will deform so as to cause the opposite effect on the volumes of said neighbouring chambers.

FIGS. 7(*a*) and 7(*b*) show a method according to a first example embodiment. As indicated by emboldened horizontal lines in FIGS. 7(*a*) and 7(*b*), based on input data, certain of the chambers within the array are assigned as firing chambers (in the example shown, chambers 10(*b*), 10(*c*), 10(*d*), 10(*h*), 10(*i*), 10(*l*)) and will deposit droplets, while the remaining chambers (in the example shown, chambers 10(*a*), 10(*e*), 10(*f*), 10(*g*), 10(*j*), 10(*k*), 10(*m*), 10(*n*)) are assigned as non-firing chambers. As is apparent from the drawing, this assignment results in bands of one or more contiguous firing chambers separated by bands of one or more contiguous non-firing chambers. As will be described in more detail below with reference to FIG. 14, this assignment may, for example, be provided (at least in part) by a screening process that is carried out on image or pattern data.

With this assignment having been carried out, the walls of certain of the chambers are then actuated. FIGS. 7(*a*) and 7(*b*) show the head at respective points in the actuation cycle. More particularly, FIG. 7(*a*) shows a point in the actuation cycle where the walls are at one extreme of their motion, whereas FIG. 7(*b*) shows the point half a cycle later, when the walls are at the opposite extreme.

As is apparent from comparing the two drawings, for each one of the firing chambers 10(*b*), 10(*c*), 10(*d*), 10(*h*), 10(*i*), 10(*l*), the walls move with opposing senses. In some examples, the actuations may comprise two phases, with half of all firing chambers being assigned to a first phase and the other half of all firing chambers being assigned to a second phase, with the firing chambers in each phase releasing droplets substantially simultaneously.

As to the non-firing chambers, two different types of behaviour for their walls may be observed: for some of the non-firing chambers, specifically, those adjacent a band of firing chambers (in the example shown, chambers 10(*a*), 10(*e*), 10(*g*), 10(*j*), 10(*k*), 10(*m*)), one wall is moved, while the other remains stationary; for other non-firing chambers, specifically those not adjacent a band of firing chambers (in the example shown, chambers 10(*f*), 10(*n*)), both walls remain stationary.

Attention is next directed to FIGS. 8(*a*) and 8(*b*), which show a method according to the same example embodiment as FIGS. 7(*a*) and (*b*), when utilised to deposit droplets in accordance with different input data. As with FIGS. 7(*a*) and 7(*b*), FIGS. 8(*a*) and 8(*b*) show the head at respective points in the actuation cycle.

As may be seen from FIGS. 8(*a*) and 8(*b*), based on the new input data, different chambers have been assigned as firing chambers and non-firing chambers. More particularly, it may noted that the assignment has resulted in a band of non-firing chambers that consists of only a single non-firing chamber, specifically chamber 10(*e*).

As is apparent from comparing the two drawings, for each one of the firing chambers 10(*b*), 10(*c*), 10(*d*), 10 (*f*), 10(*g*), 10(*h*), 10(*i*), 10(*l*), the walls move with opposing senses, as in FIGS. 7(*a*) and 7(*b*).

However, with the non-firing chambers, three (as opposed to two) different types of behaviour for their walls may be identified: for some of the non-firing chambers, specifically, those adjacent a band of firing chambers (in the example shown, chambers 10(*a*), 10(*j*), 10(*k*), 10(*m*)), one wall is moved, while the other remains stationary; for other non-firing chambers, specifically those not adjacent a band of firing chambers (in the example shown, chamber 10(*n*)), both walls remain stationary; for still others, specifically, the chamber 10 (*e*) in the single chamber wide band of non-firing chambers, the walls move with the same sense.

It may be understood that moving the walls for each firing chamber as shown in FIGS. 7 and 8 causes the release of one or more droplets from the chamber in question. The resulting droplets form bodies of fluid disposed on a line on the medium, with the bodies of fluid being separated (at least instantaneously upon landing—the fluid bodies may merge on the medium) on this line by respective gaps for each of the bands of non-firing chambers. It should be understood that the size of each such gap will thus generally correspond in size to the width of the respective band of non-firing chambers.

In order that the thus-deposited bodies of fluid lie on a line on the medium, it will often be convenient for the actuations of the firing and non-firing chambers to overlap in time. (This is, though, not essential, for example where the nozzles of the head are offset in some manner.) Further, in some cases, they may be synchronised such that the actuations for all chambers begin at the same time (though it would of course also be possible for them to be synchronised to end at the same time).

In terms of the pattern formed on the line on the medium, it will be understood that the gaps between the bodies of fluid are present because the non-firing chambers typically do not release droplets as a result of the actuations shown in FIGS. 7 and 8. It will be apparent how having the walls of certain of the non-firing chambers remain stationary generally avoids those chambers releasing droplets. Similarly, it may be apparent that having two walls of certain non-firing chambers move with the same sense will cause little, if any, material reduction in the volume of those non-firing chambers and thus may generally avoid those non-firing chambers releasing droplets.

It may further be noted in this regard that, for still other non-firing chambers, one wall is moved, while the other remains stationary. In the example embodiments shown in FIGS. 7 and 8, the non-firing chambers with such a wall movement pattern are those adjacent a band of firing chambers (in the example shown in FIG. 7, chambers 10(*a*), 10(*e*), 10(*g*), 10(*j*), 10(*k*), 10(*m*), and in the example shown in FIG. 8, chambers 10(*a*), 10(*j*), 10(*k*), 10(*m*)). This is at least in part a consequence of the actuations of the walls of the firing chambers being controlled such that, if only one of the two walls of each firing chamber were actuated the same manner, no droplets would be ejected from that firing chamber.

The inventors have discovered that, for situations where the actuations of each of the two walls of a firing chamber are independently capable of causing ejection, the actuation of both walls in combination often leads to unstable/irregular ejection. This is considered to be particularly (though not exclusively) the case with shear-sensitive fluids, such as droplet fluids with suspended particles (e.g. pigment particles where the droplet fluid is ink or particles of functional materials where the droplet fluid is for a materials deposition application).

With actuations of such magnitude, it possible for one wall of a chamber to remain stationary while the other is moved and for the chamber to nonetheless be non-firing. As is apparent from FIG. 7 in particular, non-firing chambers with such wall movements may provide a transition to non-firing chambers with both walls stationary. A possible consequence is that it is possible for a large number of the walls of the non-firing chambers to remain stationary. This may improve the lifetime of the head, by reducing the number of actuations carried out by the walls in order to achieve a certain laydown density of droplet fluid on the substrate.

The inventors consider that the methods illustrated in FIGS. 7 and 8 may be particularly suited to high laydown applications, for instance in view of the high rate of throughput, as compared with, for example, the multiple cycle actuation schemes taught by EP 0 422 870 (the method of FIGS. 7 and 8 effectively having only a single "cycle"). Further, in the method illustrated in FIGS. 7 and 8, the firing chambers may be actuating at or close to the resonant frequency. The methods illustrated in FIGS. 7 and 8 may thus achieve a "pumping power" (the amount of droplet fluid deposited per second for each inch of the width of the head) significantly higher than 500 μl/s/in., in several cases higher than 750 μl/s/in. and potentially as high as 1000 μl/s/in.

Particularly with such high laydown applications, the head may be driven fairly "hard"; thus, even small reductions in the magnitude and/or number of actuations of the walls may have a significant effect on the lifetime of the head.

Further, lifetime with a method as described with reference to FIGS. 7 and 8 may be improved as compared with other single cycle actuation schemes.

In this regard, attention is directed to FIGS. 9(*a*) and 9(*b*) which show a comparative example of a method of depositing droplets on a medium. More particularly, the method is similar to those taught with reference to FIGS. 7(*a*) and (*b*) and FIGS. 10(*a*) and (*b*) in the Applicant's earlier published PCT application, WO2010/055345A.

As is apparent from FIGS. 9(*a*) and 9(*b*), for each of the firing chambers 10(*b*)-(*d*), 10(*h*), 10(*i*), 10(*l*), the walls move with opposing senses, similarly to FIGS. 7(*a*) and 7(*b*). However, it should be noted that, for all of the non-firing chambers 10(*a*), 10(*e*)-(*g*), 10(*j*)-(*k*), 10(*m*)-(*n*), the walls move with the same sense. As will be readily apparent, such an actuation scheme results in considerably more actuations of the walls, as compared with the methods according to the example embodiments described herein, and thus typically shorter lifetimes.

Still further, it should be noted that lifetime may be improved as compared with a single cycle actuation scheme where only one wall of each firing chamber is actuated. More particularly, it is generally found that, to generate droplets of equivalent size and ejection velocity, it is necessary for a single wall to be actuated with roughly double the drive voltage required for each wall where both walls of the chamber are actuated. Further, since the magnitude of the actuations often has a non-linear effect on lifetime, such a doubling of drive voltage generally more than halves the lifetime of the wall in question and thus, by extension, the head in general.

As described above, in the method according to the example embodiment illustrated in FIGS. 7 and 8, the assignment of the chambers based on the input data may result in a band of non-firing chambers consisting of a single non-firing chamber. As also described above, the walls of each such single non-firing chamber may be actuated such that the walls move with the same sense. It should be appreciated, however, that such a wall movement pattern may be difficult to achieve with certain electrode arrangements.

One example of this is an electrode arrangement where the two actuable walls of each chamber share a respective drive electrode (for example, where each drive electrode is provided by coating internal surfaces of a respective chamber, including the surfaces of the walls). To illustrate this, if the head represented in FIG. 8 had such an electrode structure, for the walls of chamber 10(*e*) to perform the movements illustrated, there would have to be a first potential difference established between the electrode in chamber 10(*d*) and that in chamber 10(*e*), and, in order for both walls to move with the same sense, there would also have to be a potential difference—of the same sense—established between the electrode in chamber 10(*e*) and that in chamber 10(*f*). For instance, signals of −10V, 0V, and 10V might be applied to the respective electrodes in chambers 10(*d*), (*e*), and (*f*). To avoid unnecessary heating of the head, it will often be desirable that each wall's unactuated state is achieved when a 0V signal is applied to the electrodes either side of it. However, in order to then achieve the wall movement pattern for chamber 10(*e*) in FIG. 8 requires that each electrode is connected to a bi-polar voltage source, which may significantly increase the cost and complexity of the drive electronics.

Moreover, it should be appreciated that the electronics need to be still more complex in order to allow the walls of multiple adjacent chambers to all move with the same sense: this will generally require that each consecutive chamber electrode is set at an increasingly greater (or lower) voltage.

For these reasons (or otherwise), it may be desirable for the scheme for the assignment of chambers to ensure that each band of non-firing chambers consists of at least two non-firing chambers. In this regard, attention is directed to FIGS. 10(*a*) and (*b*), which illustrate a method according to a further example embodiment where the assignment of chambers as firing and non-firing chambers ensures that each band of non-firing chambers consists of at least two non-firing chambers. This method acts on the same input data as in FIG. 8 and, as is apparent from FIGS. 10(*a*) and (*b*), a space of two non-firing chambers 10(*d*)-(*e*) is forced between the left-most bands of firing chambers (chambers 10(*b*)-(*c*) and chambers 10(*f*)-(*i*) respectively). As is also apparent from FIGS. 10(*a*) and (*b*), for a band of non-firing chambers consisting of two chambers, it is possible for the walls of each chamber to be actuated such that, one wall moves while the other is stationary.

In the methods according to the example embodiments described with reference to FIGS. 7, 8 and 10, the walls of the firing chambers may be actuated such that each firing chamber's walls move in anti-phase. For instance, throughout the actuation cycle the walls may be moving with opposite senses and acting to alternately increase and reduce the volume of the firing chambers. As will be apparent, the anti-phase motion of the walls of firing chambers will tend to cause an oscillation in the pressure of the fluid throughout the channel.

It may be convenient to take account of modal effects within the actuator structure so as to reduce the amount of energy required to effect droplet release. Clearly, any chamber containing fluid will have one or more natural frequencies for pressure oscillation, which may result from various factors such as the compliance and geometry of the chamber. In particular, when a wall is deformed, an acoustic pressure wave may be set up within the chamber. Specifically, when the volume of a chamber is increased by movement of a wall away from that chamber, a negative pressure wave is generated at the nozzle of the chamber, which propagates away from the nozzle.

In the case of a long thin chamber open at one or both longitudinal ends, the open ends constitute a mismatch of acoustic impedances and thus will act as such wave-reflecting acoustic boundaries. Acoustic waves propagating along the length of the chamber will therefore be reflected by these boundaries but—owing to the 'open' nature of the boundaries—the reflected waves will be of opposite sense to the original wave. By synchronising the oscillation of the chamber walls with the arrival of acoustic waves at or near the chamber aperture, the pressure generated by wall deformation may combine with the acoustic wave pressure to enable controlled ejection. In the case of a long thin chamber having open ends, the acoustic waves may take a time L/2c (where L is the length of the channel and c is the speed of sound for the particular combination of fluid and chamber) to travel from the open ends to an aperture equidistant from the ends. Thus, the frequency of oscillation of these waves is approximately L/c; by operating the chamber walls at a multiple of this frequency, controlled droplet release may be achieved with reduced energy input. In general, a higher frequency will lead to faster operation of the apparatus and thus a frequency of approximately L/c may be desirable.

As discussed above, with reference to FIGS. 7, 8 FIGS. 7(*a*) and (*b*), FIGS. 8(*a*) and (*b*), or FIGS. 10(*a*) and (*b*) that during each half of the actuation cycle, roughly half of the firing chambers will release droplets. In order to synchronise the release of droplets across the array it is advantageous that this release is carried out substantially simultaneously. It will, of course, be appreciated that synchronisation of 'half' of the firing channels is intended to include the situation where an odd number of firing channels is present as a contiguous region and thus the number of firing chambers in each 'half' of this region will differ by one. For example, in a region of five contiguous firing chambers, two may release droplets during the first half-cycle and the remaining three may release droplets during the second half-cycle, or vice versa.

Figure 11:
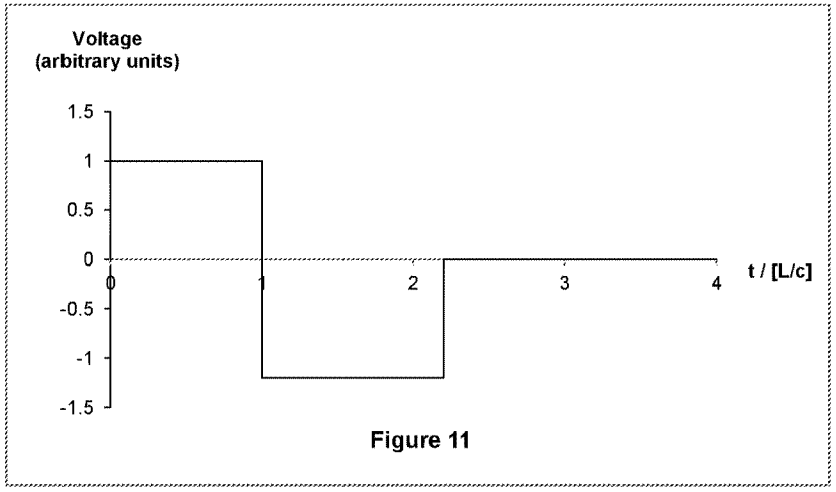
FIG. 11 shows a drive waveform that may be applied to the wall of a firing channel.

FIG. 11 shows a drive waveform that may be applied across a wall of a firing chamber in a method according to the example embodiments described with reference to FIGS. 7, 8 and 10. This waveform may, for example, correspond to the potential difference between the voltage signals applied to the electrodes either side of the wall in question. With such an electrode arrangement, a bipolar voltage may be applied across a wall by applying a respective unipolar signal to each of the neighbouring electrodes, so that one signal provides positive portions of the voltage across the wall and the other signal provides negative portions, or simply by applying a bipolar signal to one of the electrodes.

It should be appreciated that there is typically a direct relationship between the voltage across the wall and the position of the wall: where the voltage difference is held at zero the wall is undeformed; where the voltage is held at a positive value the wall is deformed towards the first chamber and where the voltage is held at a negative value the wall is deformed towards the second chamber. The movement of the wall will tend to lag behind the voltage signal owing to the response time of the system.

In order to cause the walls of a firing chamber to move with opposite senses, as described above with reference to FIGS. 7, 8 and 10, a waveform as shown in FIG. 11 may be applied to one wall of the firing chamber and a drive waveform of opposite polarity may be applied to the other wall of the firing chamber. It may also be noted at this point that the waveform shown in FIG. 11 may be applied to the moving wall of a non-firing chamber, in the case where the non-firing chamber has one wall that is moved, while the other remains stationary, or indeed to both walls of a non-firing chamber, in the case where both walls of the non-firing chamber move with the same sense (in which case the drive waveforms should have the same polarity).

Returning now to FIG. 11, it may be noted that the drive waveform comprises two square wave portions: the first portion corresponding to a movement towards the first channel and after a first period of time a movement back to an undeformed position, and the second portion corresponding to a movement towards the second channel and after a second period of time a movement to revert to its undeformed state. During operation, the first portion contributes to the release of a droplet from the first chamber, while the second portion contributes to the release of a droplet from the second chamber.

Where the time spacing between first and second portions is of a similar magnitude to the response time of the system the wall may move directly from deformation towards the first chamber to deformation towards the second chamber with no appreciable pause in its undeformed state and may thus be considered a single continuous movement from first chamber to second.

Figure 12:
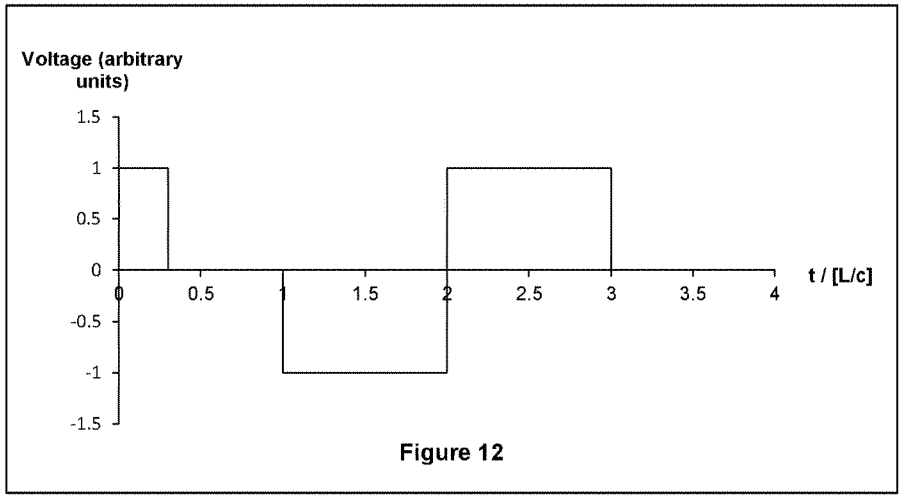
FIG. 12 shows a further a drive waveform that includes a non-ejection pulse.

An alternative waveform, shown in FIG. 12, comprises the same portions preceded by similar portions (pre-pulses) which do not cause ejection directly, but rather initiate acoustic waves which are then reinforced by the further pressure pulses generated by the main waveform portions.

As is discussed above, the movements of the walls may be timed to coincide with the presence at the nozzle of acoustic wave pulses so as to reduce the energy required for ejection. This may, for example, be accomplished by having the leading edge of the second waveform portion at a time approximately L/c after the leading edge of the first waveform portion.

As will be apparent from FIG. 11, the second portion is longer and has a greater amplitude: thus, the energy imparted by the second portion is greater than the first. This will result in the second droplet being released with greater velocity than the first, and may also result in the two droplets having different volumes. By altering the lengths and amplitudes of the wave portions, it is possible to arrive at a waveform giving equal volumes but different speeds. The difference in speeds may then be utilised to ensure that the two droplets land on a medium substantially simultaneously and thus are aligned relative to the direction of medium movement. Extending this principle to all firing chambers, it is possible to ensure the formation of a line of droplets on the medium.

It should be appreciated that in practice each droplets of fluid may not all be exactly centred on a line on the medium, but that a straight line will at least pass through all the spots; put differently, the droplets are disposed on a single line.

The method of depositing droplets may include a second (a third, a fourth etc.) assigning step and a corresponding second (third, fourth etc.) actuating step, with the first and second assigning steps being based on respective portions of the input data and with the resulting droplets for the first and second (third, fourth etc.) actuating steps forming bodies of fluid disposed on respective, spaced-apart lines on the medium.

By depositing several such lines of bodies of fluid on a medium a two-dimensional pattern of fluid can be created, with individual control over the deposition of every droplet making up the pattern.

It will therefore be apparent that the present invention may be of particular benefit in printing images or forming two-dimensional patterns (or, indeed, successive two-dimensional patterns, as in 3D printing). In the case of image formation, each line of droplets may represent a line of image data pixels and any error inherent in the representation of each line may be distributed to neighbouring lines using a process such as dithering.

According to a still further example embodiment, the waveform causing ejection of the second droplet may be preceded by an additional waveform portion or 'pre-pulse'. As shown in FIG. 12, this pre-pulse is of shorter duration and thus lesser energy than the later pulses causing ejection. The pre-pulse does not immediately lead to ejection but initiates acoustic waves whose energy increases the velocity of the second droplet and thus serves to align the two droplets on the medium. Such waveforms may be applicable in situations where control over the amplitude of the voltage is not available.

Figure 13:
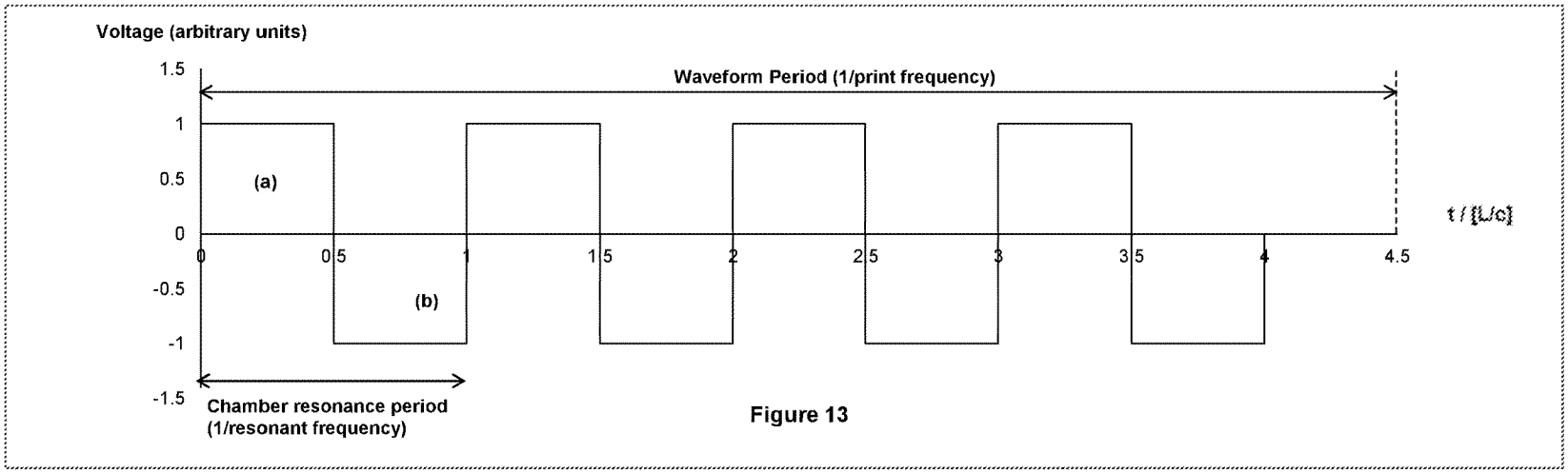
FIG. 13 shows a drive waveform that includes a number of pulses to be applied to the wall of a firing chamber, thus generating a train of droplets.

FIG. 13 shows a drive waveform for use in a method according to a still further example embodiment. Whereas the waveforms shown in FIGS. 11 and 12 consisted of only one positive square wave portion and one negative square wave portion, the waveform shown in FIG. 13 consists of a plurality of such square wave portions. When such a drive waveform is applied to the wall separating two firing chambers (with drive waveforms of opposite polarity being applied to the other walls of the two firing chambers), the square waves each cause the release of a droplet of fluid from the apertures of the respective fluid chambers to form a growing train of droplets. Such a train of droplets may, for example, merge at the nozzle, progressively growing into a larger drop with the final actuation causing the break-off of the train from the nozzle. Of course, in other examples the train of droplets might instead merge during flight to the medium, or on the medium itself.

It should be appreciated that the total volume of the train of droplets may thus be approximately proportional to the number of square waves, with each successive square wave adding a further quantum of fluid.

In some cases, the head may be provided with a family of waveforms, with a certain waveform being selected in accordance with the size of the train of droplets that it is desired to form, thus enabling "greyscale" deposition to be carried out.

In other cases, substantially the same drive waveform may be used for all firing chambers (though, as noted above, with different polarities for the two walls of each firing chamber) and thus each firing chamber will release the same number of droplets, and thus the size of the dots formed on the substrate is essentially fixed. While this clearly will not afford a variety of dot sizes to be produced on the substrate, as it results essentially in a binary printing process, it has been found that, in many cases, a train of droplets of a given volume will be formed and travel to the substrate more reliably than a single droplet of the same volume. Thus, where binary printing is acceptable, such a process will provide improved reliability with an attendant increase in printing through-put common to all embodiments.

Though not shown in FIG. 13, it may be advantageous to include pre-pulses (as described above with reference to FIG. 12) before a series of actuations that causes the release of a train of droplets that form a corresponding body of fluid on the medium.

As before, an appropriate number of pre-pulses may be chosen for each chamber so that the additional acoustic wave energy leads to the alignment of droplets on the medium.

Alternatively (or in addition), the length and/or amplitude of the individual pulses of the drive waveform may be selected, during design/setup of the head, so that the respective trains of droplets that are produced by two firing chambers separated by a wall driven with the drive waveform arrive on the medium at substantially the same time.

FIG. 13 further indicates the distinction between the frequency with which the walls of the firing chambers oscillate (which, as noted above, is at or near the resonant frequency) and the print frequency. As may be seen, the print frequency is significantly smaller than the resonant frequency, as the full drive waveform includes a plurality of square pulses and, typically, a small rest period that may assists in the dissipation of acoustic waves within the chambers.

While the above exemplary embodiments make reference to waveforms comprising square wave portions, it will be appreciated by those skilled in the art that waveform portions of various forms such as triangular, trapezoidal, or sinusoidal waves may be used as appropriate depending on the particular droplet deposition head.

It should be appreciated that the methods described above with reference to FIGS. 7, 8 and 10-13 may be implemented in a droplet deposition head in a wide variety of ways. Nonetheless, certain illustrative examples will now be described with reference to FIGS. 14(*a*) and 14(*b*), which are schematic diagrams of respective droplet deposition apparatuses that may be configured to carry out the methods described above with reference to FIGS. 7, 8 and 10-13.

Figure 14A:
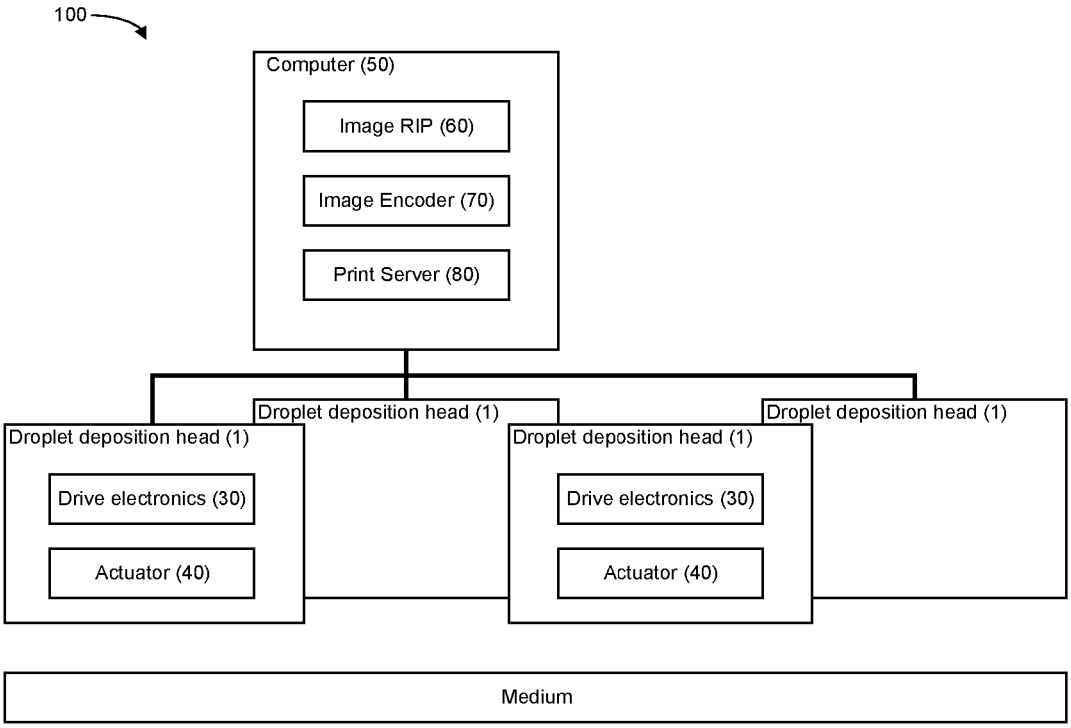
FIG. 14 is a schematic illustrate of a droplet deposition apparatus that may be configured to carry out the methods illustrated in FIGS. 7, 8 and 10-13.
Figure 14B:
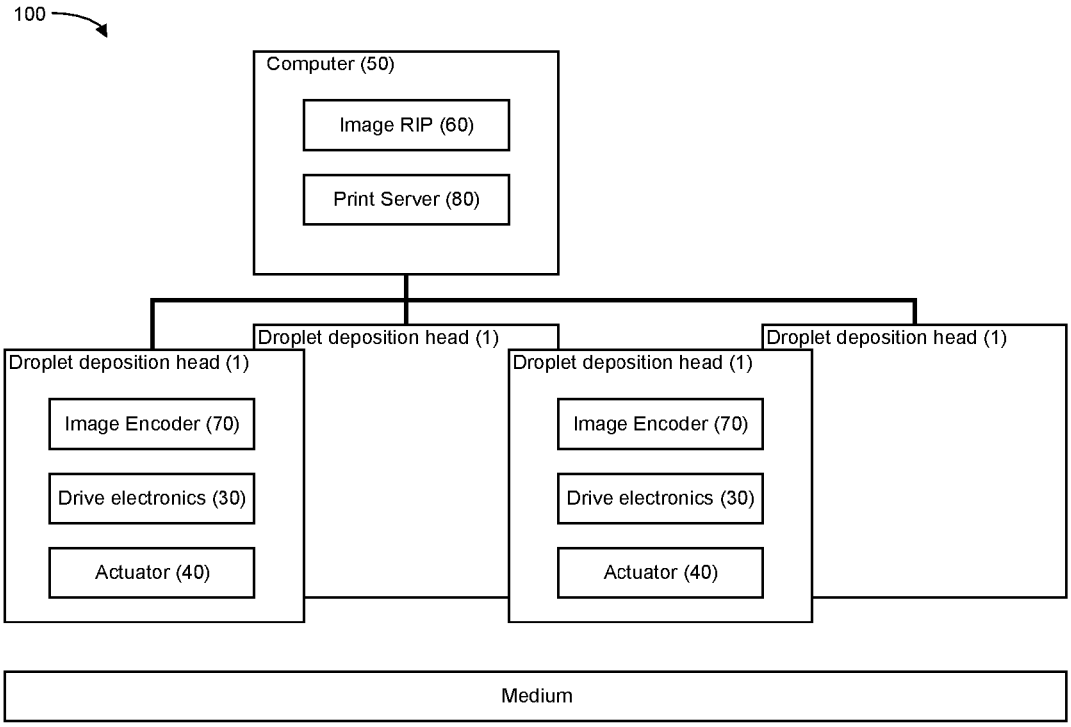

Turning first to FIG. 14(*a*), it is apparent that the droplet deposition apparatus 100 comprises a computer 50 and a number of droplet deposition heads 1. Typically, the droplet deposition heads 1 will be disposed in an array, with some overlap in the direction of the nozzle rows, so that the array of heads can deposit droplets onto the medium over the whole of a contiguous swathe. While not shown in the drawing, it will be appreciated that the droplet deposition apparatus 100 will generally also include an electrically powered system for moving the medium relative to the array of droplet deposition heads 1. As shown by the emboldened lines, the heads 1 are in data communication with the computer 50. This data link (which typically would be via electrical cabling, but could be wireless) allows the computer to send instructions to the droplet deposition heads 1 so as to cause them to carry out actuations as described above with reference to FIGS. 7, 8 and 10-13.

In the particular implementation shown in FIG. 14(*a*), the computer is provided with software for an image RIP (raster image processor) 60, an image encoder 70 and a print server 80. Such software might, for example, be stored on data storage forming part of the computer and be executed by the computer's processor(s). The image RIP takes, as its input, image or pattern data, and coverts this into data defining a pattern of dots to be formed on the medium by the droplet deposition heads 1.

The conversion carried out by the image RIP 60 will typically include a screening process, which converts the pattern encoded in the input data into data defining a pattern that the droplet deposition heads 1 are capable of forming on the medium, given their limitations in terms of, for example, spatial and tone resolution.

In terms of the spatial resolution, the screening process will take account of the desired size of the pattern to be formed on the medium, as well as the resolution achievable by the heads 1. The screening process will also take account of the difference between the tone resolution of the input data and the tone resolution achievable by the heads. In some cases, such as image printing applications, the heads may provide a higher spatial resolution, but a significantly lower tone resolution, since images may have, for example, 255 levels for each pixel (in each colour), whereas greyscale printers can typically form single dots with only 6 or 8 different levels, for instance. Of course, with a number of materials deposition applications, such as varnish coating, the input data may be binary, in which case little adjustment for tone resolution may be necessary.

Where the droplet deposition apparatus 100 includes a number of heads 1, as is the case in FIG. 14(*a*), the image RIP 60 may also determine which parts of the input data are to be printed by which head 1.

As noted above, the image RIP 60 takes account of the limitations of the heads 1 in terms of forming patterns on the medium. As part of this, it may be designed so as to take account of limitations of the head that are more complex than spatial and tone resolution. Thus, the image RIP 60 may be designed so as to take account of a specific actuation scheme.

For instance, a suitable image RIP may be designed to take account of the restriction discussed above with reference to FIG. 10, where each band of non-firing chambers must include two or more non-firing chambers.

Turning now to the image encoder 70, this receives the screened pattern data from the image RIP and converts this into data that defines the actuations to be carried out by the chamber walls within the actuator 40 of each head 1. The print server 80 then receives this data and distributes it to the appropriate head 1 within the array.

The drive electronics 30 within each head then receives the data from the image encoder 70 and generates and applies corresponding waveforms to the walls of the actuator 40 of that head 1. As a result, a corresponding pattern is formed on the medium.

While in the droplet deposition apparatus 100 shown in FIG. 14(*a*) the image encoder 70 is provided on the computer 50, it should be understood that an image encoder 70 could instead by provided on each head 1 within the apparatus 100. FIG. 14(*b*) shows an example of such a droplet deposition apparatus 100. As shown in the drawing, in such a case, the print server 80 may distribute data from the image RIP to the appropriate one of the heads 1, with the image encoder 70 provided by the head then converting the pattern data into actuation commands to be converted by the drive electronics 30 into drive waveforms. As with the apparatus 100 of FIG. 14(*a*), the drive electronics 30 within each head then applies these waveforms to the walls of the actuator 40 of that head 1, thus forming a corresponding pattern on the medium.

It will be appreciated from the description above of FIGS. 14(*a*) and 14(*b*) that the assignment of firing and non-firing chambers may be implemented in practice by suitable image RIP 60 and image encoder 70 processes. Thus, the methods described above with reference to FIGS. 7, 8, and 10-13 may, for instance, be implemented in certain existing droplet deposition apparatuses 100 by configuring them with a new image RIP 60 process and a new image encoder 70 process.

With an apparatus 100 as shown in FIG. 14(*a*), this might, for example, simply involve installing new software on the computer 50. With an apparatus 100 as shown in FIG. 14(*b*), where the image encoder 70 is implemented on each head 1, this might, for example, involve installing new firmware on each head 1, in addition to installing new software on the computer 50.

Of course, these are only examples of how the methods described above with reference to FIGS. 7, 8 and 10-13 might be implemented; a wide variety of possibilities exists, depending on the particular heads 1 that are utilised. As a generalised example, to implement the methods described above, an apparatus or a head may include data storage having instructions stored thereon that, when executed by one or more processors that form part of the apparatus or head, cause the apparatus or head to carry out a method as described herein.

It should further be noted that the methods described above with reference to FIGS. 7, 8 and 10 to 14 are susceptible of use with all the droplet deposition head constructions described with reference to FIGS. 1 to 6 and, more generally, with droplet deposition heads that: comprise an array of fluid chambers separated by interspersed walls, with each fluid chamber communicating with an aperture for the release of droplets of fluid and each of the walls separating two neighbouring chambers; and in which each of the walls is actuable such that, in response to a first voltage (e.g. a voltage of one polarity), it will deform so as to decrease the volume of one chamber and increase the volume of the other chamber, and, in response to a second voltage (e.g., a voltage of the opposite polarity) it will deform so as to cause the opposite effect on the volumes of said neighbouring chambers.

Accordingly, it will be understood that the present disclosure more generally provides, in one aspect, a method for depositing droplets onto a medium utilising a droplet deposition head comprising: an array of fluid chambers separated by interspersed walls, each fluid chamber communicating with an aperture for the release of droplets of fluid and each of said walls separating two neighbouring chambers; wherein each of said walls is actuable such that, in response to a first voltage, it will deform so as to decrease the volume of one chamber and increase the volume of the other chamber, and, in response to a second voltage, it will deform so as to cause the opposite effect on the volumes of said neighbouring chambers; the method comprising the steps of: (a) receiving input data; (b) assigning, based on said input data, all the chambers within said array as either firing chambers or non-firing chambers so as to produce bands of one or more contiguous firing chambers separated by bands of one or more contiguous non-firing chambers; (c) actuating the walls of certain of said chambers such that: for each non-firing chamber, either one wall is stationary while the other is moved, or the walls move with the same sense, or they remain stationary; and for each firing chamber the walls move with opposing senses; said actuations resulting in each said firing chamber releasing at least one droplet, the resulting droplets forming bodies of fluid disposed on a line on said medium, said bodies of fluid being separated on said line by respective gaps for each of said bands of non-firing chambers, the size of each such gap generally corresponding in size to the respective band of non-firing chambers; wherein the actuations of the walls of said firing chambers in said actuating step, (c), are such that, if only one of the two walls of each firing chamber were actuated in such manner, no droplets would be ejected from that firing chamber.

In some examples, the assigning step, (b), may comprise determining, in accordance with said input data, a width for each band of firing chambers; the width may, for instance, take any natural number value that is determined in accordance with the input data. In addition, or instead, the assigning step, (b), may comprise determining, in accordance with said input data, a width for each band of non-firing chambers. In some cases, the width may, for instance, take any natural number value that is determined in accordance with the input data. In other cases, the width may take any integer value greater than 1 that is determined in accordance with the input data.

In some examples, the actuations of the actuating step, (c), may overlap in time. In some cases, the actuations of the actuating step, (c), may begin and/or end generally simultaneously.

In some examples, the method further comprises a plurality of assigning steps, (b), and a corresponding plurality of actuating steps, (c), the plurality of assigning steps being based on said input data; wherein the resulting droplets for said plurality of actuating steps, (c), form bodies of fluid disposed on respective, spaced-apart lines on said medium; and wherein, for each such line, the corresponding bodies of fluid are separated by respective gaps for each of the bands of non-firing chambers assigned in the corresponding assigning step, (b), with the size of each such gap generally corresponding in size to the respective band of non-firing chambers.

In some examples, the walls may comprise piezoelectric material. For example, they may be formed substantially of piezoelectric material. In some cases, the chambers may be formed in a body of piezoelectric material.

In some examples, the fluid deposited may be a shear sensitive fluid.

In a further aspect, the present disclosure provides a droplet deposition apparatus, which comprises one or more droplet deposition heads, each head comprising: an array of fluid chambers separated by interspersed walls, each fluid chamber being provided with an aperture and each of said walls separating two neighbouring chambers; each of said walls being actuable such that, in response to a first voltage, it will deform so as to decrease the volume of that chamber and increase the volume of the other chamber, in response to a second voltage, it will deform so as to cause the opposite effect on the volumes of said neighbouring chambers. Such a droplet deposition apparatus is configured to carry out a method as described herein.

In some examples, the droplet deposition apparatus may comprise at least one processor and data storage having instructions stored thereon that, when executed by said at least one processor, cause the droplet deposition apparatus to carry out a method as described herein.

In a still further aspect, the present disclosure provides a droplet deposition head comprising: an array of fluid chambers separated by interspersed walls, each fluid chamber being provided with an aperture and each of said walls separating two neighbouring chambers; each of said walls being actuable such that, in response to a first voltage, it will deform so as to decrease the volume of that chamber and increase the volume of the other chamber, in response to a second voltage, it will deform so as to cause the opposite effect on the volumes of said neighbouring chambers. Such a droplet deposition head is configured to carry out a method as described herein.

In some examples, the droplet deposition head may comprise at least one processor and data storage having instructions stored thereon that, when executed by said at least one processor, cause the droplet deposition head to carry out a method as described herein.

It should further be appreciated that, depending on the application, a variety of fluids may be deposited using the methods and droplet deposition heads described above.

For instance, a droplet deposition head may eject droplets of ink that may travel to a sheet of paper or card, or to other receiving media, such as ceramic tiles or shaped articles (e.g. cans, bottles etc.), to form an image, as is the case in inkjet printing applications (where the droplet deposition head may be an inkjet printhead or, more particularly, a drop-on-demand inkjet printhead).

Alternatively, droplets of fluid may be used to build structures, for example electrically active fluids may be deposited onto receiving media such as a circuit board so as to enable prototyping of electrical devices.

In another example, polymer containing fluids or molten polymer may be deposited in successive layers so as to produce a prototype model of an object (as in 3-D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the preceding disclosure may be drop-on-demand droplet deposition heads. In such heads, the pattern of droplets ejected varies in dependence upon the input data provided to the head.

Finally, it should be noted that a wide range of examples and variations are contemplated within the scope of the appended claims. Accordingly, the foregoing description should be understood as providing a number of non-limiting examples that assist the skilled reader's understanding of the present invention and that demonstrate how the present invention may be implemented.

The invention claimed is:

1. A method for depositing droplets onto a medium utilizing a droplet deposition apparatus, the method comprising:

receiving, at the droplet deposition apparatus, input data for releasing droplets, the droplet deposition apparatus comprising an array of fluid chambers separated by interspersed walls, each fluid chamber communicating with an aperture for the release of droplets of fluid and each of the walls separating two neighboring chambers;

assigning, based on the input data, each of the chambers within the array as either firing chambers or non-firing chambers so as to produce bands of one or more contiguous firing chambers separated by bands of one or more contiguous non-firing chambers; and actuating the walls of at least a subset of the chambers such that:

for at least one non-firing chamber, one wall is stationary while the other is moved; and for each firing chamber the walls move with opposing senses, wherein:

each of the walls is actuable such that in response to a first voltage, the respective wall will deform so as to decrease the volume of a first one of the chambers and increase the volume of a second one of the chambers, and in response to a second voltage, the respective wall will deform so as to cause an opposite effect on the volumes of the first and the second chambers; and the resulting droplets forming bodies of fluid disposed on a line on the medium, the bodies of fluid being separated on the line by respective gaps for each of the bands of non-firing chambers, a size of each gap corresponding in size to the respective band of non-firing chambers.

2. A method according to claim 1, wherein:

actuating the walls comprise two phases, with substantially half of the firing chambers being assigned to a first phase and the other firing chambers being assigned to a second phase; and the firing chambers in each phase release droplets substantially simultaneously.

3. A method according to claim 2, wherein:

actuating the walls cause:

the release of a train of n droplets, where n is an integer greater than 1, from each firing chamber in the first phase, and the release of a train of m droplets from each firing chamber in the second phase;

m differs from n by at most 1; and each of the train of n droplets and the train of m droplets form a corresponding one of the bodies of fluid on the medium.

4. A method according to claim 3, wherein trains of the same number of droplets are released from each one of the firing chambers.

5. A method according to claim 4, wherein n is an integer between 4 and 10.

6. A method according to claim 1, wherein actuating the walls begins or ends substantially simultaneously.

7. A method according to claim 1, wherein, for any band of non-firing chambers consisting of a single non-firing chamber, the walls move with a same sense.

8. A method according to claim 7, wherein, for each of the bands of non-firing chambers comprising two or more non-firing chambers:

the walls remain stationary for each chamber within such a band and not adjacent a firing chamber; and one wall remains stationary while another wall is moved for each chamber within such a band and adjacent a firing chamber.

9. A method according to claim 1, wherein:

assigning each of the chambers within the array comprises assigning the chambers such that each band of non-firing chambers comprises at least two non-firing chambers; and actuating the walls comprises:

leaving the walls stationary for each chamber within a band of non-firing chambers and is not adjacent to a firing chamber; and leaving at least one wall stationary while moving other walls wall for each chamber within a band of non-firing chambers and adjacent to a firing chamber.

10. A method according to claim 9, wherein two actuable walls of each one of the chambers share a respective electrode for applying drive signals to those two walls.

11. A method according to claim 1, wherein actuating the walls result in walls of each firing chamber oscillating at or close to a resonant frequency for the respective firing chamber.

12. A method according to claim 1, further comprising a plurality of assigning steps and a corresponding plurality of actuating steps, the plurality of assigning steps being based on the input data;

wherein:

resulting droplets for the plurality of actuating steps form bodies of fluid disposed on respective spaced-apart lines on the medium; and for each spaced-apart line, the corresponding bodies of fluid are separated by respective gaps for each of the bands of non-firing chambers assigned in the corresponding assigning step, with the size of each gap substantially corresponding in size to the respective band of non-firing chambers.

13. A droplet deposition apparatus comprising:

one or more droplet deposition heads, wherein each of the droplet deposition heads comprises:

an array of fluid chambers separated by interspersed walls, each fluid chamber being provided with an aperture and each of the walls separating two neighboring chambers; each of the walls being actuable such that, in response to a first voltage, the respective wall will deform so as to decrease the volume of a first chamber and increase the volume of a second chamber, in response to a second voltage, the respective wall will deform so as to cause an opposite effect on the volumes of the first and the second chambers;

wherein the droplet deposition apparatus is configured to carry out a method for depositing droplets onto a medium , the method comprising steps of:

receiving input data;

assigning, based on the input data for releasing droplets, each of the chambers within the array as either firing chambers or non-firing chambers so as to produce bands of one or more contiguous firing chambers separated by bands of one or more contiguous non-firing chambers; and actuating the walls of at least a subset of the chambers such that:

for at least one non-firing chamber, one wall is stationary while the other is moved; and for each firing chamber the walls move with opposing senses; wherein:

the resulting droplets form bodies of fluid disposed on a line on the medium, the bodies of fluid being separated on the line by respective gaps for each of the bands of non-firing chambers, a size of each gap generally corresponding in size to the respective band of non-firing chambers.

14. A droplet deposition apparatus according to claim 13, further comprising a computer in data communication with the one or more droplet deposition heads, wherein the computer is programmed to carry out the assigning step based on the input data.

15. A droplet deposition apparatus according to claim 14, wherein the computer is further programmed to send instructions to the one or more droplet deposition heads, so as to cause them to carry out the actuating step.

16. A droplet deposition apparatus according to claim 13, wherein the droplet deposition apparatus is a printhead.

17. A droplet deposition apparatus according to claim 16, wherein apertures for substantially each of the fluid chambers are disposed on a straight line.

18. A droplet deposition apparatus according to claim 16, wherein two actuable walls of each chamber share a respective electrode for applying drive signals to those two walls.

19. A system for depositing droplets onto a medium, the system comprising:

one or more droplet deposition heads, each of the one or more droplet deposition heads comprising an array of fluid chambers separated by interspersed walls, each fluid chamber communicating with an aperture for the release of droplets of fluid and each of the walls separating two neighboring chambers; wherein each of the walls is actuable such that, in response to a first voltage, the respective wall will deform so as to decrease the volume of a first chamber and increase the volume of a second chamber, and, in response to a second voltage, the respective wall will deform so as to cause an opposite effect on the volumes of the first and the second chambers; and one or more memory devices storing computer instructions for configuring the one or more droplet deposition heads to carry out a method for depositing droplets onto the medium utilizing the one or more droplet deposition heads, the method comprising:

receiving input data;

assigning, based on the input data, each of the chambers within the array as either firing chambers or non-firing chambers so as to produce bands of one or more contiguous firing chambers separated by bands of one or more contiguous non-firing chambers; and actuating the walls of at least a subset of the chambers such that:

for at least one non-firing chamber, one wall is stationary while the other is moved; and for each firing chamber the walls move with opposing senses, wherein:

the resulting droplets forming bodies of fluid disposed on a line on the medium, the bodies of fluid being separated on the line by respective gaps for each of the bands of non-firing chambers, a size of each gap generally corresponding in size to the respective band of non-firing chambers.

20. The system according to claim 19, wherein apertures for each of the fluid chambers are disposed on substantially a straight line.

* * * * *